US006647235B2

(12) United States Patent
Patterson et al.

(10) Patent No.: US 6,647,235 B2
(45) Date of Patent: Nov. 11, 2003

(54) MECHANISM FOR AGITATING THE TONER IN THE REPLENISHER OF AN ELECTROPHOTOGRAPHIC MACHINE

(75) Inventors: Kenneth M. Patterson, Rochester, NY (US); Paul E. Thompson, Webster, NY (US); Laverne N. Lincoln, Jr., Macedon, NY (US); James G. Blum, Livonia, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/141,254

(22) Filed: May 8, 2002

(65) Prior Publication Data

US 2003/0002890 A1 Jan. 2, 2003

Related U.S. Application Data

(60) Provisional application No. 60/302,163, filed on Jun. 29, 2001.

(51) Int. Cl.[7] ..... G03G 15/08

(52) U.S. Cl. ..... 399/254; 366/327.3; 399/258

(58) Field of Search ..... 399/254, 258, 399/260, 263; 366/316, 325.92, 325.93, 327.1, 327.3; 222/DIG. 1

(56) References Cited

U.S. PATENT DOCUMENTS

| | | | | |
|---|---|---|---|---|
| 4,344,692 A | * | 8/1982 | Oda | 399/254 |
| 4,887,911 A | * | 12/1989 | Miyaji | 399/254 |
| 5,229,823 A | | 7/1993 | Kalyandurg et al. | 118/612 |
| 5,970,284 A | | 10/1999 | Garcia et al. | 399/120 |
| 5,995,783 A | | 11/1999 | Garcia et al. | 399/120 |

FOREIGN PATENT DOCUMENTS

| | | | |
|---|---|---|---|
| JP | 56-9768 A | * | 1/1981 |
| JP | 7-13420 A | * | 1/1995 |

* cited by examiner

*Primary Examiner*—Joan Pendegrass

(57) ABSTRACT

A replenisher for facilitating flow of toner in an electrophotographic apparatus. The replenisher includes a sump for receiving the toner. An beater element having a plurality of blades is rotatably mounted within the sump wherein some of the blades impart a shear force and a normal force along the axis of rotation to the toner while others of the blades impart a shear force and a normal force towards or away from the axis of rotation to the toner as the beater is rotated through the toner. This effectively "aerates" the toner and keeps it mobile within the sump.

13 Claims, 3 Drawing Sheets

MECHANISM FOR AGITATING THE TONER IN THE REPLENISHER OF AN ELECTROPHOTOGRAPHIC MACHINE

RELATED APPLICATIONS

This application is entitled to and hereby claims the benefit of the filing date of U.S. provisional application No. 60/302,163 filed Jun. 29, 2001.

FIELD OF THE INVENTION

The present invention relates to a mechanism for agitating the toner in the replenisher of an electrophotographic copier/printer machine and in one of its aspects relates to a replenisher for supplying toner in an electrophotographic machine wherein the replenisher has a specially designed "beater" element which effectively aerates the toner particles and keeps them in a fluid state so that they readily flow from the replenisher upon demand.

BACKGROUND OF THE INVENTION

In a typical electrophotographic machine (e.g. copier, duplicator, printer, etc.), a continuous loop of photoconductor film is commonly used to transfer an image from an input section onto a receiving medium (e.g. a sheet of paper or the like). The film is charged and passed through an input section where an image (i.e. analog or digital) is projected onto the charged film. The film then moves through a developing section where toner (i.e. dry ink) is applied to the charged image before the image is transferred to the sheet of paper. The paper is subsequently passed through a fuser section where the toner is fixed to the paper by passing the paper between a pressure roller and a heated roller.

Before applying the toner to the charged image, many electrophotograpic machines mix the toner with a carrier to form a two-component developer. When using two-component developers, it is necessary to maintain a desired ratio of toner to carrier; this ratio being commonly known as "toner concentration" or "TC". Typically, the TC may range from about 2% to about 14% by mass for general printing applications. However, as will be understood, the actual range of the TC may vary over different ranges depending on the densities and/or relative size of the particular toner and carrier particles being used.

To maintain the proper TC in a particular machine, the toner typically flows from a source (e.g. a bottle or other container) into a mechanism known as a "replenisher" which, in turn, feeds the toner to the developer at a desired rate. Since the charge of toner dictates other process settings within the printing/copying machine, it is vital that the replenisher be capable of maintaining a consistent and controllable flow rate of toner to the developer throughout the printing operation.

Unfortunately, however, it is sometimes difficult to maintain a constant flow rate of toner from the replenisher; especially when certain materials have to be added to the toner to alleviate other problems (i.e. "toner rub-off") which may be encountered during operation. "Toner rub-off" is an image quality defect that is created when the friction between two sheets of paper causes some of the fused toner on a original sheet to "rub-off" onto second sheet as the second sheet moves across the original sheet. To alleviate rub-off, certain additives, such as waxes, are added to the toner before they are fed into the replenisher.

In doing this, problems arise in that typical additives which reduce rub-off often increase the cohesiveness between the toner particles to the extent that they sometimes tend to stick to one another. This, in turn, can cause "bridging" within the replenisher and/or the toner source (e.g. bottle) which feeds the replenisher. As will be understood, "bridging" is the phenomenon wherein abutting particles of toner adhere together to form a contiguous mass of toner which, in turn, blocks or inhibits the flow of toner particles past the "bridge". Accordingly, bridging in the replenisher can prevent the necessary free flow of toner through the exit opening(s) in the replenisher thereby adversely affecting the TC needed for the successful operation of the developer.

To help in preventing bridging in the toner source and/or the replenisher, other additives, e.g. silica, powders, etc., are often added to the toner particles to reduce the unwanted cohesiveness therebetween. However, it has been found that in some cases where the cohesiveness between the toner particles has been reduced, the toner then flowed too well. This, in turn, unfortunately increases the packing density or "volume fraction" of the toner (i.e. volume of toner/volume of replenisher). If the volume fraction is increased beyond a set value, the toner becomes packed within the replenisher and often impedes the motion of the agitator element (e.g. oscillating basket, rotating wire or blade elements, etc.) which is provided in the replenisher to keep the toner particles in a fluid state. If the agitator becomes impeded, the ability of the replenisher to furnish fresh toner reliably is greatly compromised. In some known machines, stalling of the agitator mechanism is also likely to stall the associated feed apparatus, e.g. a feed auger, thereby halting all toner replenishment to the developer which, in turn, requires shut-down of the machine.

Accordingly, those skilled in this art will readily appreciate the need for a replenisher, which has the capability to keep the toner in a state of flux as the toner is supplied from a source (e.g. toner bottle) into the developing station of an electrophotographic machine. This will allow the flow rate of the toner particles, hence the TC, to remain substantially constant throughout the operation of the machine thereby maintaining a high quality product throughout the printing operation.

SUMMARY OF THE INVENTION

The present invention provides a replenisher for agitating particulate toner to facilitate flow of toner in an electrophotographic apparatus. Basically, the replenisher is comprised of a housing having a sump, which is adapted to receive and store the toner until needed. An agitator element is rotatably mounted within said sump and is adapted to impart both shear and normal forces to the toner as the agitator element is rotated through the toner. This effectively "aerates" the toner and keeps it mobile as it is fed to the developing station in the electrophotographic apparatus.

More specifically, the agitator element of the present invention is a beater element having a hub, which is mounted on a shaft, which, in turn, is rotatably mounted in the housing of the replenisher and which extends through the sump.

A plurality of blades extend radially outwardly from the hub wherein all of the blades are designed to impart substantial shear force to the toner in said sump. Some of the blades are designed to impart a substantial normal force along the rotational axis of the beater element while others of the blades are designed to impart substantial normal force to the toner partially towards or away from the axis of rotation when the hub is rotated. The plurality of blades is aligned in first and second sets, each set being comprised of a pair of diametrically-opposed blades extending outwardly from the hub.

The first set(s) of blades are constructed to impart shear force and a normal force in the axial direction to the toner when rotated therethrough and the second set(s) of blades are constructed to impart shear force and a force normal to the rotation plane, towards or away from the axis of rotation, to said toner when rotated therethrough. The outer ends of all of the blades are twisted at a first angle (e.g. about 30°) with respect to the radial plane of said beater element. However, only the outer ends of the second sets of blades are bent at a second angle (about 45°) with respect to the respective radial axis of the blade with the ends of the blades in each set of the second sets of blades being bent outward from the radial axis in different directions.

The replenisher also includes means for delivering an impact to the toner in the sump, which is basically the same as found in known replenishers of this type. This means is comprised of a cam, which is affixed onto one end of the shaft on which the beater element is mounted. An impact element comprised of a leaf spring having a weight thereon is mounted on the outside of said housing. The impact element is adapted to be engaged by the cam when said shaft is rotated to thereby push the impact element away from said housing and then release it so that the bias of the leaf spring will cause the weight to deliver an impact to said housing.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

DESCRIPTION OF THE PREFERRED EMBODIMENTS

Figure 1:
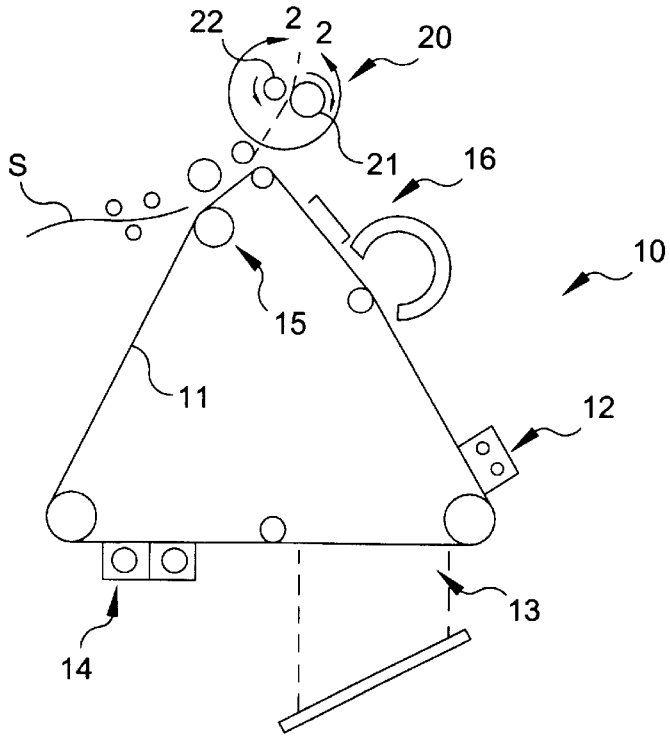
FIG. 1 is a schematic view of an electrophotographic apparatus (e.g. copier/printer machine) in which the present invention can be incorporated.

Referring briefly to FIG. 1, a typical electrophotographic apparatus or machine 10 (e.g. copier, duplicator, printer) of the kind that has an endless photoconductor member 11 (e.g. photographic film) which moves through a closed loop past a charging station 12, an exposure or input station 13, a developing station 14, a transfer station 15, and an erase section 16. A copy medium (e.g. a sheet S of paper) is fed from a supply (not shown) through transfer station 15 where the toner image on the film 11 is transferred onto the paper S. The paper S is then fed between a fuser roller 21 and a pressure roller 22 in fuser section 20 to fix the toner image on the paper S before the paper exits the machine.

Figure 2:
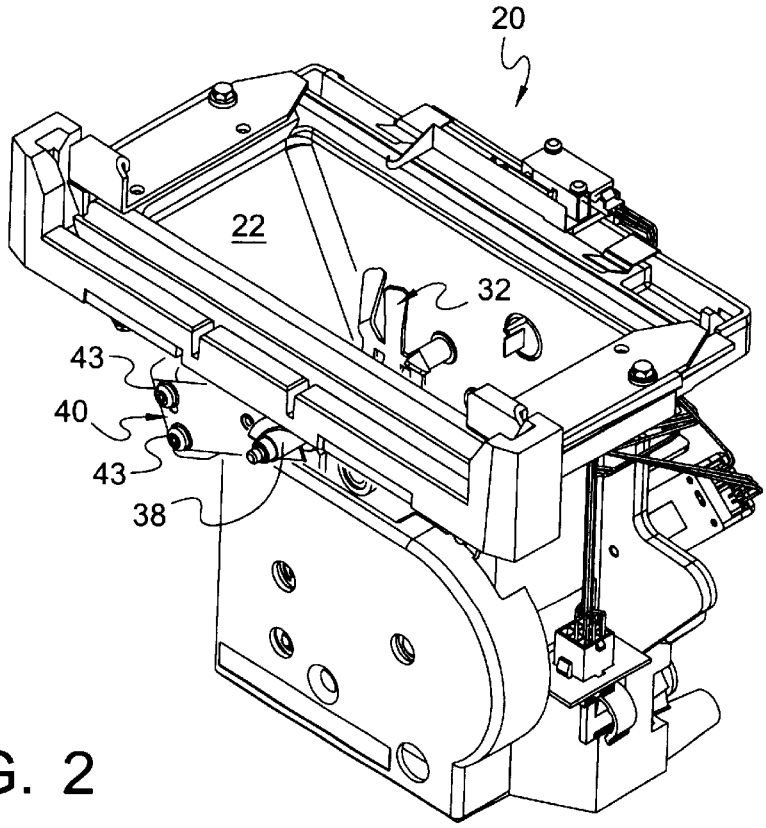
FIG. 2 is a perspective view of the replenisher of the present invention useful for supplying toner to the developing station of the apparatus of FIG. 1.
Figure 4:
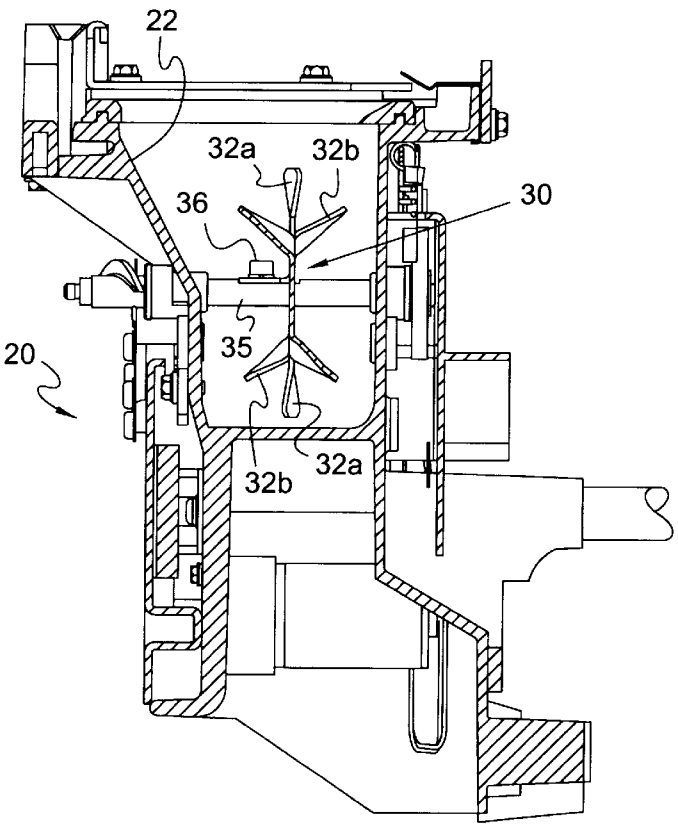
FIG. 4 is a cross-sectional, side view of the replenisher of FIG. 3.
Figure 3:
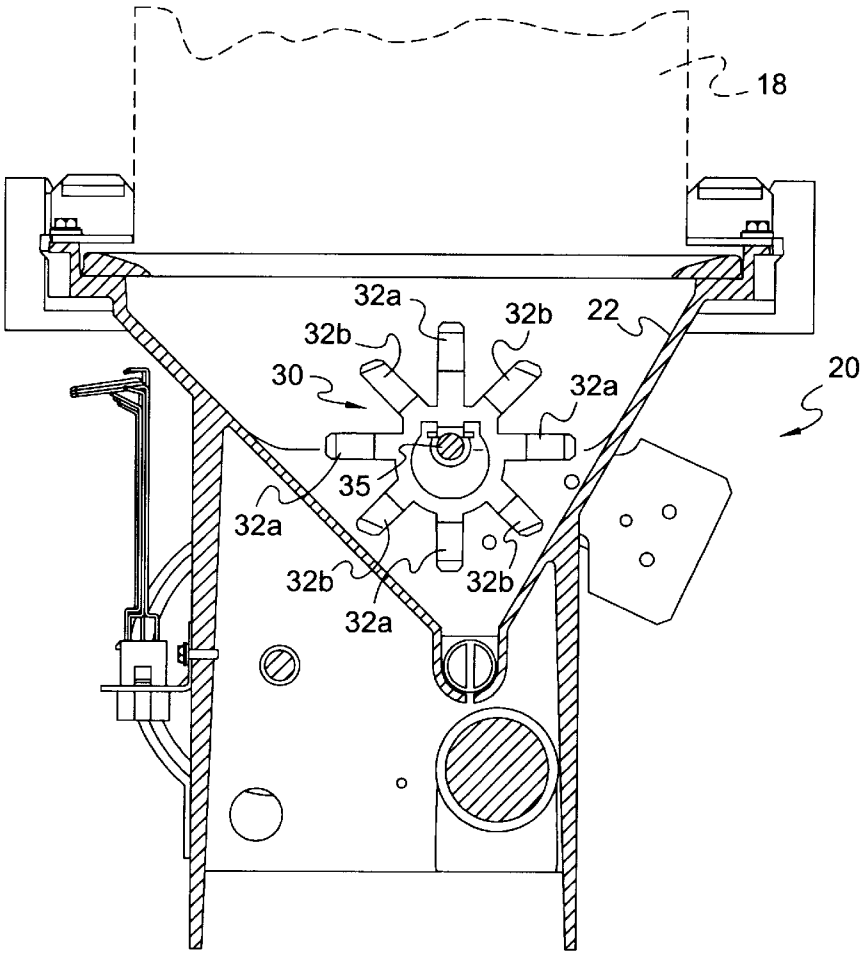
FIG. 3 is a cross-sectional, rear view of the replenisher of FIG. 2 showing the "beater" element of the present invention.

In an apparatus such as that illustrated in FIG. 1, particles of a toner (e.g. a pigmented, thermoplastic, resinous material) is typically supplied from a source (e.g. a bottle 18, shown only in dotted lines in FIG. 3; also see U.S. Pat. No. 5,995,783 for such a source) to developing station 14 through a replenisher 20 (FIGS. 2–4). An open end of bottle 18 is removably positioned onto the inlet 21 of the replenisher 20 and toner is allowed to flow by gravity into the sump 22 where it is stored until needed. Unfortunately, however, it has been found that the rate at which the toner flows from the lower end of sump 22 is often erratic and non-uniform. This is caused in part due to the nature and fine size of the toner particles which have a tendency to pack or adhere together to form bridge(s) in the sump which, in turn, impedes the free flow of toner therefrom.

In the past, various approaches have been made to maintain free flow of the toner particles from the sump of the replenisher. These approaches have included the use of vibrators attached to the walls of the sump; rocking the sump, itself; various types of sifting devices; and agitator devices which are positioned within the sump and in contact with the toner. For example, one agitator device uses a basket-like structure which oscillates within the sump to aid in keeping the particles of toner in a loosened state; see U.S. Pat. No. 5,229,823.

Other agitator devices have included "beater elements" which rotate in contact with the toner in the sump to stir or "beat" the toner in an attempt to keep the toner particles from compacting. These beater elements have taken various forms, e.g. wire segments which extend from a hub which, in turn, is rotated by a drive shaft extending into the sump of the replenisher. Unfortunately, these wire segments are often unable to withstand the bending stresses and the shock forces typically imposed thereon during operation of the electrophotographic machine.

Figure 5:
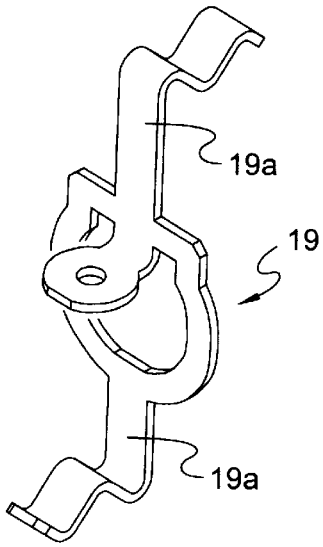
FIG. 5 (PRIOR ART)
FIG. 5 is an enlarged, perspective view of a prior art beater element for a replenisher.

Another type of known beater element is a shear force type agitator, such as the beater element 19 shown in FIG. 5. Element 19 has a pair of diametrically-opposed blades 19*a*, the ends of which are bent outwardly in opposed directions. While this type of beater element is sturdier that those having wire blades, the design of blades 19*a* are such that they basically impart only a shear force to the toner as they rotate therethrough. Accordingly, blades 19*a* will loosen only the thin layer of toner with which they come into contact with little, if any, force being imparted normal to the blades. This results in substantially no toner being moved in the direction of rotation. Therefore, gravity must be relied as the primary force to move the loosen toner out of the sump of the replenisher.

In accordance with the present invention, replenisher 20 is provided with a beater element 30 which imparts both a shear force and a normal force to the toner in sump 22 as element 30 rotates therein. This effectively "aerates" the toner and keeps it in a fluid state so that it can flow freely from replenisher 20 when needed. More specifically, beater element 30 is comprised of a hub 31 from which a plurality of blades 32 radiate outward therefrom. Preferably, element 30 is cast or machined as an integral component but it should be recognized that element 30 could be made in parts and then assembled by welding or the like.

Figure 7:
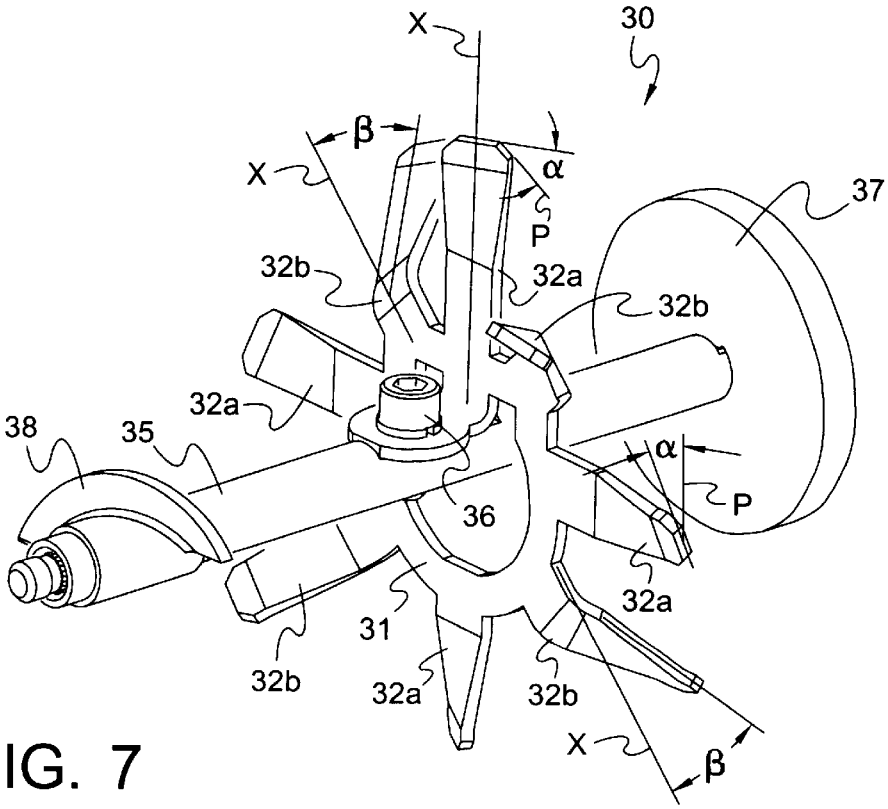
FIG. 7 is an enlarged, perspective view of the beater element of the present invention removed from the replenisher.

As best shown in FIG. 7, preferably beater element 30 is formed with eight, radially-extending blades which are equally spaced around hub 31. First sets (i.e. pairs) of the blades, i.e. 32*a* are designed to impart shear force and a normal force along the axis of rotation to the toner upon rotation while second sets of the blades, i.e. 32*b* are designed to impart a shear and a normal force towards and away from the axis of rotation to the toner as they pass therethrough. As used herein, a "set" of blades is comprised of two, diametrically-opposed blades 32 which extend radially outward from hub 31.

To impart the desired forces to the toner, the outer end of each of the plurality of the blades 32 of beater element 30 is twisted in relation to the radial plane P of the element 30 at an angle $\alpha$ (FIG. 7). Then, only the outer ends of the second set of blades 32*b* are bent away from the radial axis x at an angle $\beta$. In bending the ends of blades 32*b*, one blade of a set of diametrically-opposed blades 32*b* is bent away from axis x in one direction while the other blade of the set is bent away from axis x in the opposite direction (see FIG. 4). While both angles $\alpha$ and $\beta$ can vary in particular situation, preferably $\alpha$ is equal to about 30° while angle $\beta$ is equal to about 45°.

Figure 6:
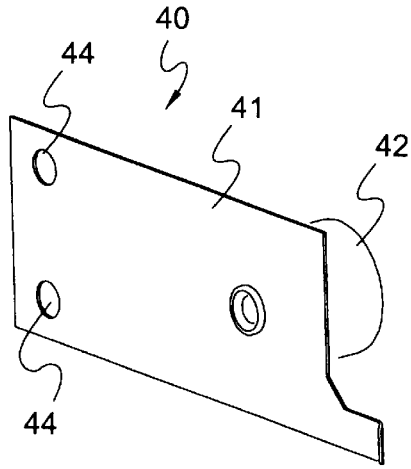
FIG. 6 (PRIOR ART)
FIG. 6 is an enlarged, perspective view of a prior art impact element which can be used in the present invention.

Beater element is secured onto shaft 35 by a screw 36 or the like. Shaft 35 has a gear 37 at one end which is adapted to be driven by a motor (not shown). A cam 38 is affixed about the other end of shaft 35 and is adapted to engage impact element 40 (see FIGS. 2 AND 6). Impact element 40 is comprised of a leaf spring component 41 which has a weight 42 secured to its inside surface at one end and which is secured to the side of replenisher sump 22 by screws 43 (FIG. 2) or the like which extend through openings 44 (FIG. 6). As shaft 35 rotates, the cam 38 engages the leaf spring 41 to lift it away from the sump 22. When the leaf spring drops off the top of cam 38, the bias of the spring forces the weight 42 into contact with the sump 22 to deliver an impact to the toner in the sump. The impact element 40 and its operation are known and can be found in other replenishers of this type; see U.S. Pat. No. 5,229,823.

By imparting both shear and normal forces to the toner, the beater is better capable of keeping the toner in a loosened state and alleviates the problem of bridging within the sump.

What is claimed is:

1. A replenisher for agitating particulate toner to facilitate flow of said toner in an electrophotographic apparatus; said replenisher comprising:

a sump in said replenisher adapted to receive said toner;

an agitator element rotatably mounted within said sump and adapted to impart both shear and normal forces to said toner as said agitator element is rotated in said sump, wherein said agitator element comprises:

a beater element comprising:

a shaft rotatably mounted and extending through said sump;

a hub mounted on said shaft for rotation therewith; and a plurality of blades extending radially outwardly from said hub wherein some of said plurality of blades impart a shear force and a force normal along the axis of rotation of said hub to said toner in said sump when said hub is rotated and wherein others of said plurality of blades impart a shear force and a normal force towards or away from said axis of rotation to said toner in said sump when said hub is rotated.

2. The replenisher of claim 1 wherein said plurality of blades is comprised of first and second sets of blades, each of said sets comprising a pair of diametrically-opposed blades extending outwardly from said hub;

said first set of blades constructed to impart said shear force and said force normal along the axis of rotation of said hub to said toner in said sump when rotated therethrough; and said second set of blades constructed to impart said shear force and said normal force towards or away from said axis of rotation to said toner in said sump when rotated therethrough.

3. The replenisher of claim 2 wherein the outer end of each of said plurality of blades is twisted at a first angle with respect to the radial plane of said beater element.

4. The replenisher of claim 3 wherein the outer end of each of said blades of said second set of blades is bent at a second angle with respect to the radial axis of said blade.

5. The replenisher of claim 4 wherein said outer ends of the blades in each set of the second sets of blades are bent outward from the radial axis in different directions from each other.

6. The replenisher of claim 4 wherein said first angle is equal to about 30° and said second angle is equal to about 45°.

7. The replenisher of claim 5 including:

a cam affixed on one end of said shaft;

an impact element mounted on the outside of said sump and adapted to be engaged by said cam when said shaft is rotated to thereby lift said impact element away from said sump and then release said impact element whereby said impact element will deliver an impact to said sump.

8. A beater element for a replenisher in an electrophotographic apparatus, said beater element comprising:

a hub adapted to be mounted on a shaft for rotation therewith; and a plurality of blades extending radially outwardly from said hub wherein some of said plurality of blades impart a shear force and a force normal along the axis of rotation of said hub to said toner in said sump when said hub is rotated and wherein others of said plurality of blades impart a shear force and a normal force towards or away from said axis of rotation to said toner in said sump when said hub is rotated.

9. The beater element of claim 8 wherein said plurality of blades is comprised of first and second sets of blades, each of said sets comprising a pair of diametrically-opposed blades extending outwardly from said hub;

said first set of blades constructed to impart said shear force and said force normal along the axis of rotation of said hub to said toner in said sump when rotated therethrough; and said second set of blades constructed to impart said shear force and said normal force towards or away from said axis of rotation to said toner in said sump when rotated therethrough.

10. The beater element of claim 9 wherein the outer end of each of said plurality of blades is twisted at a first angle with respect to the radial plane of said beater element.

11. The beater element of claim 10 wherein the outer end of each of said blades of said second set of blades is bent at a second angle with respect to the radial axis of said blade.

12. The beater element of claim 11 wherein said first angle is equal to about 30° and said second angle is equal to about 45°.

13. The beater element of claim 11 wherein said outer ends of the blades in each set of the second sets of blades are bent outward from the radial axis in different directions from each other.

* * * * *